US011965670B2

(12) United States Patent
Willis, Sr.

(10) Patent No.: US 11,965,670 B2
(45) Date of Patent: Apr. 23, 2024

(54) PROTECTIVE COVERING DEVICE

(71) Applicant: Eddie Willis, Sr., N. Las Vegas, NV (US)

(72) Inventor: Eddie Willis, Sr., N. Las Vegas, NV (US)

( * ) Notice: Subject to any disclaimer, the term of this patent is extended or adjusted under 35 U.S.C. 154(b) by 154 days.

(21) Appl. No.: 17/730,320

(22) Filed: Apr. 27, 2022

(65) Prior Publication Data

US 2023/0349588 A1 Nov. 2, 2023

(51) Int. Cl.

| | |
|---|---|
| ***E04H 15/44*** | (2006.01) |
| ***E04H 15/02*** | (2006.01) |
| ***F24F 1/58*** | (2011.01) |
| ***F24F 13/20*** | (2006.01) |

(52) U.S. Cl.

CPC ..... *F24F 13/20* (2013.01); *E04H 15/02* (2013.01); *E04H 15/44* (2013.01)

(58) Field of Classification Search

CPC ..... E04H 15/44; F24F 1/56; F24F 1/58

See application file for complete search history.

(56) References Cited

U.S. PATENT DOCUMENTS

| | | | | |
|---|---|---|---|---|
| 2,914,075 A | | 2/1955 | Wells | |
| 3,379,481 A | * | 4/1968 | Fisher | F24F 13/20 312/100 |
| 3,722,845 A | * | 3/1973 | Unger | F24F 1/0003 248/346.03 |
| D319,872 S | | 9/1991 | Holt | |
| 6,138,993 A | * | 10/2000 | Mitchell, Jr. | F24F 1/58 256/25 |
| 6,158,175 A | * | 12/2000 | Carter | F24F 1/58 52/79.5 |
| 6,186,158 B1 | * | 2/2001 | Goarin | F24F 1/58 135/128 |
| 6,430,954 B1 | * | 8/2002 | Smith | F24F 1/58 206/320 |
| 6,595,017 B1 | * | 7/2003 | Teahan | F24F 1/50 62/DIG. 13 |
| 6,708,514 B1 | * | 3/2004 | Miller | F24F 1/58 62/507 |
| 10,174,956 B2 | * | 1/2019 | Stanton | F24F 1/58 |
| 11,203,867 B2 | * | 12/2021 | Ferland | F24F 13/20 |
| 11,767,991 B1 | * | 9/2023 | Marshall | F24F 1/58 160/19 |
| 2008/0178624 A1 | * | 7/2008 | Zedney | F24F 1/58 62/259.1 |
| 2008/0264021 A1 | * | 10/2008 | Hoover | F24F 1/58 55/493 |

(Continued)

*Primary Examiner* — Noah Chandler Hawk

(57) ABSTRACT

A protective covering device for outdoor equipment includes a tube and a lid. The tube is sized complementarily to an outdoor article, such as an outdoor element of an air conditioning system, to an exterior element of a heat pump system, or to an outdoor evaporative cooler. The tube is positionable around the outdoor article so that a bottom of the tube is substantially coplanar with a lower end of the outdoor article. The tube protects substantially all side surfaces of the outdoor article from solar radiation, weather, and airborne debris. A plurality of apertures is positioned in the tube and allows airflow into and out of the tube. The lid is selectively engageable to a top of the tube and thus protects an upper surface of the outdoor article.

13 Claims, 8 Drawing Sheets

(56) References Cited

U.S. PATENT DOCUMENTS

| | | | | |
|---|---|---|---|---|
| 2009/0249842 | A1* | 10/2009 | Coon | F24F 1/58<br>70/58 |
| 2013/0005238 | A1* | 1/2013 | Brandt | F24F 13/14<br>454/275 |
| 2013/0154450 | A1* | 6/2013 | Ramsey | F24F 1/56<br>29/428 |
| 2013/0161215 | A1* | 6/2013 | Dowdy | F24F 1/58<br>206/320 |
| 2017/0205087 | A1* | 7/2017 | Zhang | E05B 73/00 |

* cited by examiner

PROTECTIVE COVERING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to protective devices and more particularly pertains to a new protective device for outdoor equipment. The present invention discloses a protective device which can be assemble around an outdoor article and which provides protection from solar radiation, weather, and airborne debris, while allowing for airflow through the protective device.

(2) Description of Related Art Including Information Disclosed Under 37 CFR 1.97 and 1.98

The prior art relates to protective devices for outdoor articles, which may comprise sunscreens attachable to outdoor element of an air conditioning systems. What is lacking in the prior art is a protective device which can be assemble around an outdoor article and which provides protection from solar radiation, weather, and airborne debris, while allowing for airflow through the protective device.

BRIEF SUMMARY OF THE INVENTION

An embodiment of the disclosure meets the needs presented above by generally comprising a tube and a lid. The tube is sized complementarily to an outdoor article, such as an outdoor element of an air conditioning system, to an exterior element of a heat pump system, or to an outdoor evaporative cooler. The tube is configured to be positioned around the outdoor article so that a bottom of the tube is substantially coplanar with a lower end of the outdoor article. The tube is configured to protect substantially all side surfaces of the outdoor article from solar radiation, weather, and airborne debris. A plurality of apertures is positioned in the tube and is configured to allow airflow into and out of the tube. The lid is selectively engageable to a top of the tube and thus is configured to protect an upper surface of the outdoor article.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
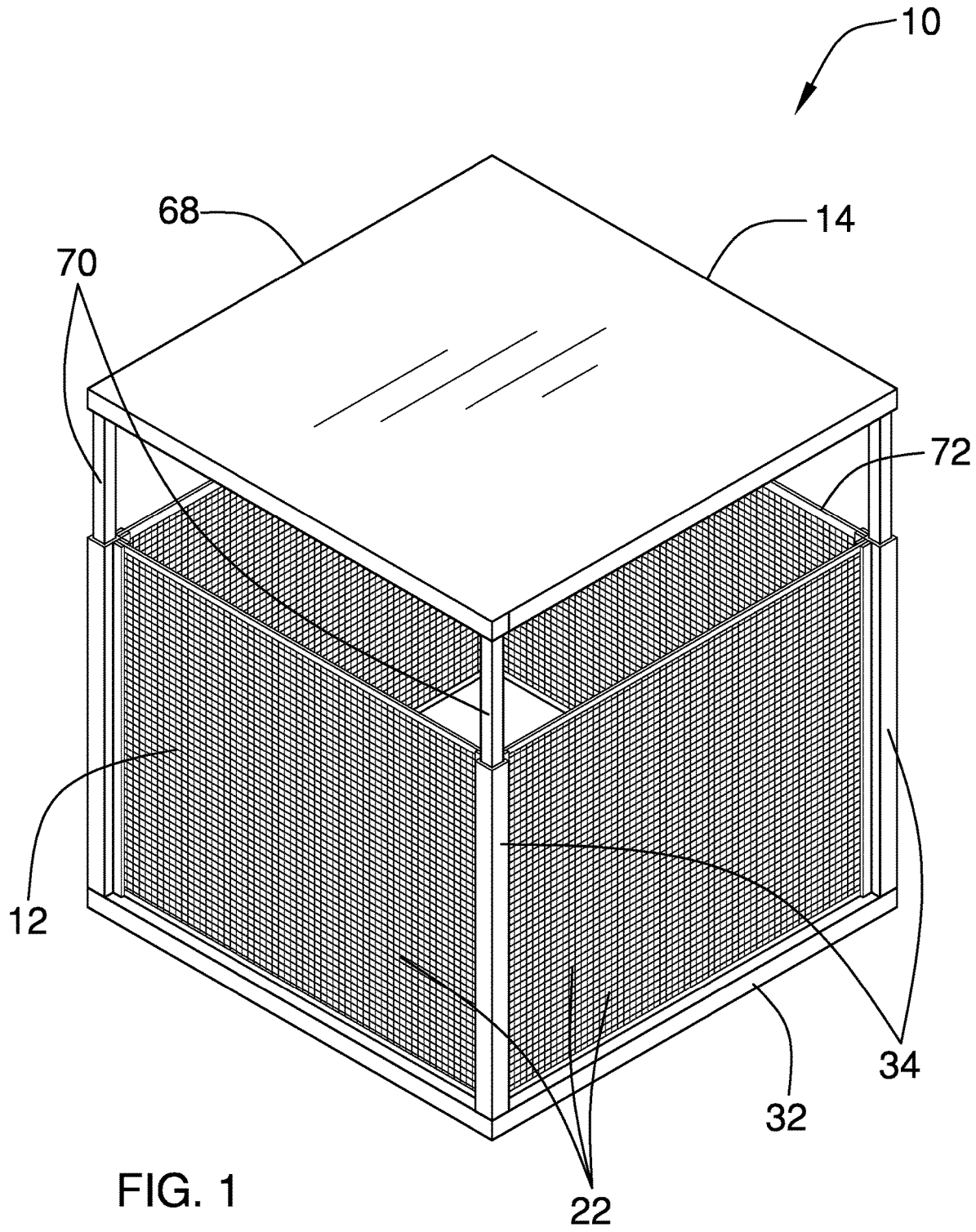
FIG. 1 is an isometric perspective view of a protective covering device according to an embodiment of the disclosure.
Figure 2:
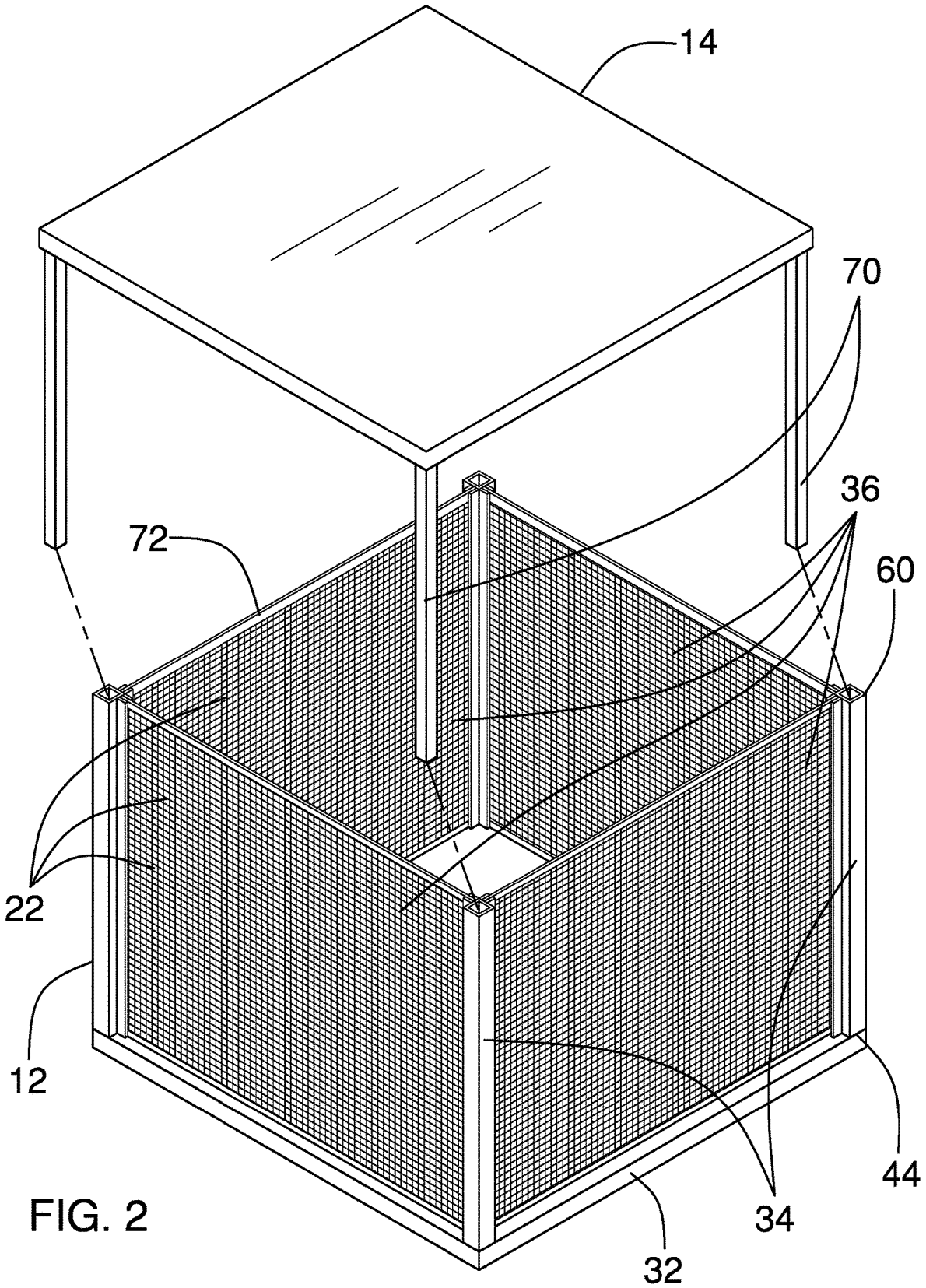
FIG. 2 is an isometric perspective view of an embodiment of the disclosure.
Figure 3:
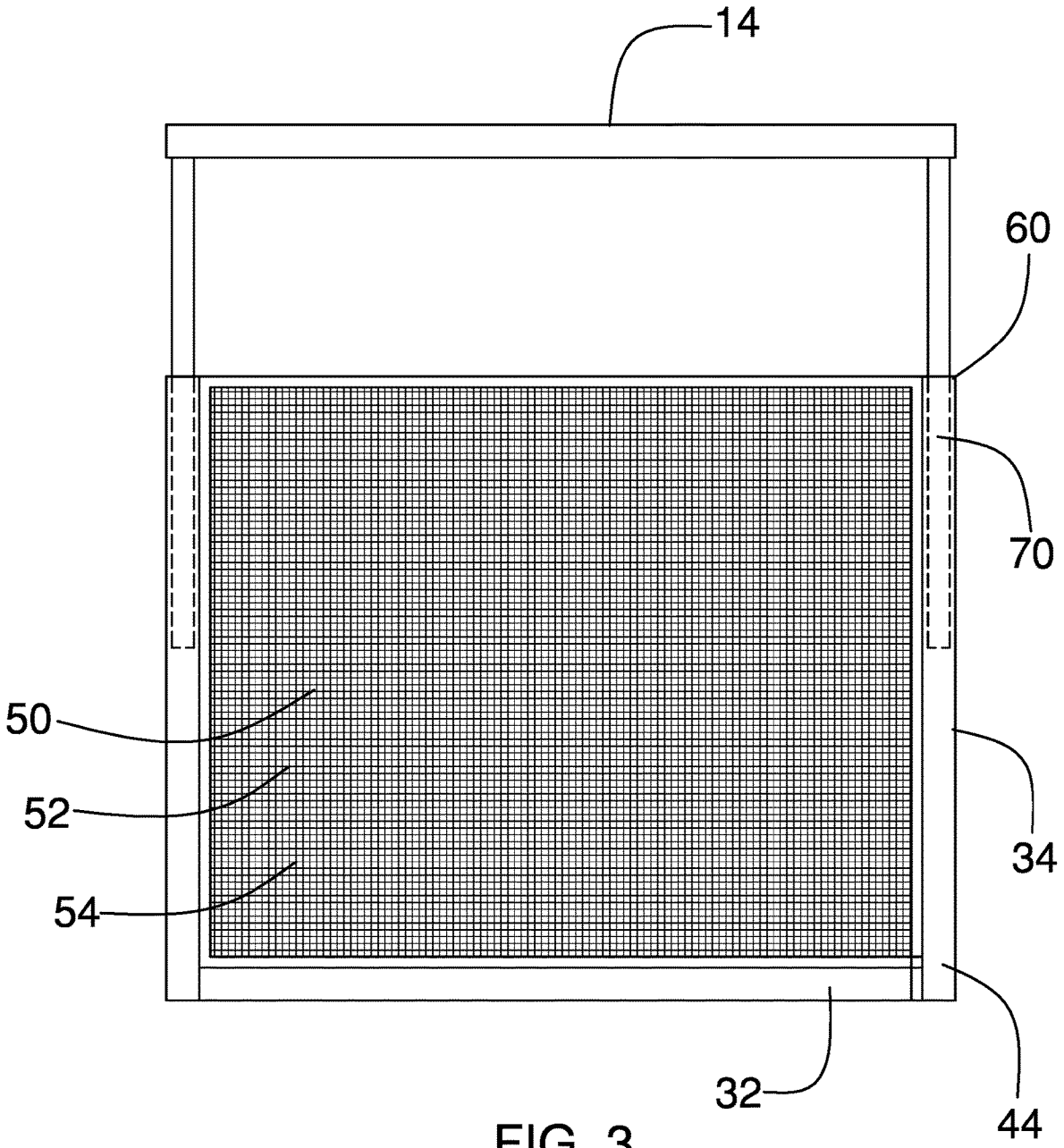
FIG. 3 is a side view of an embodiment of the disclosure.
Figure 4:
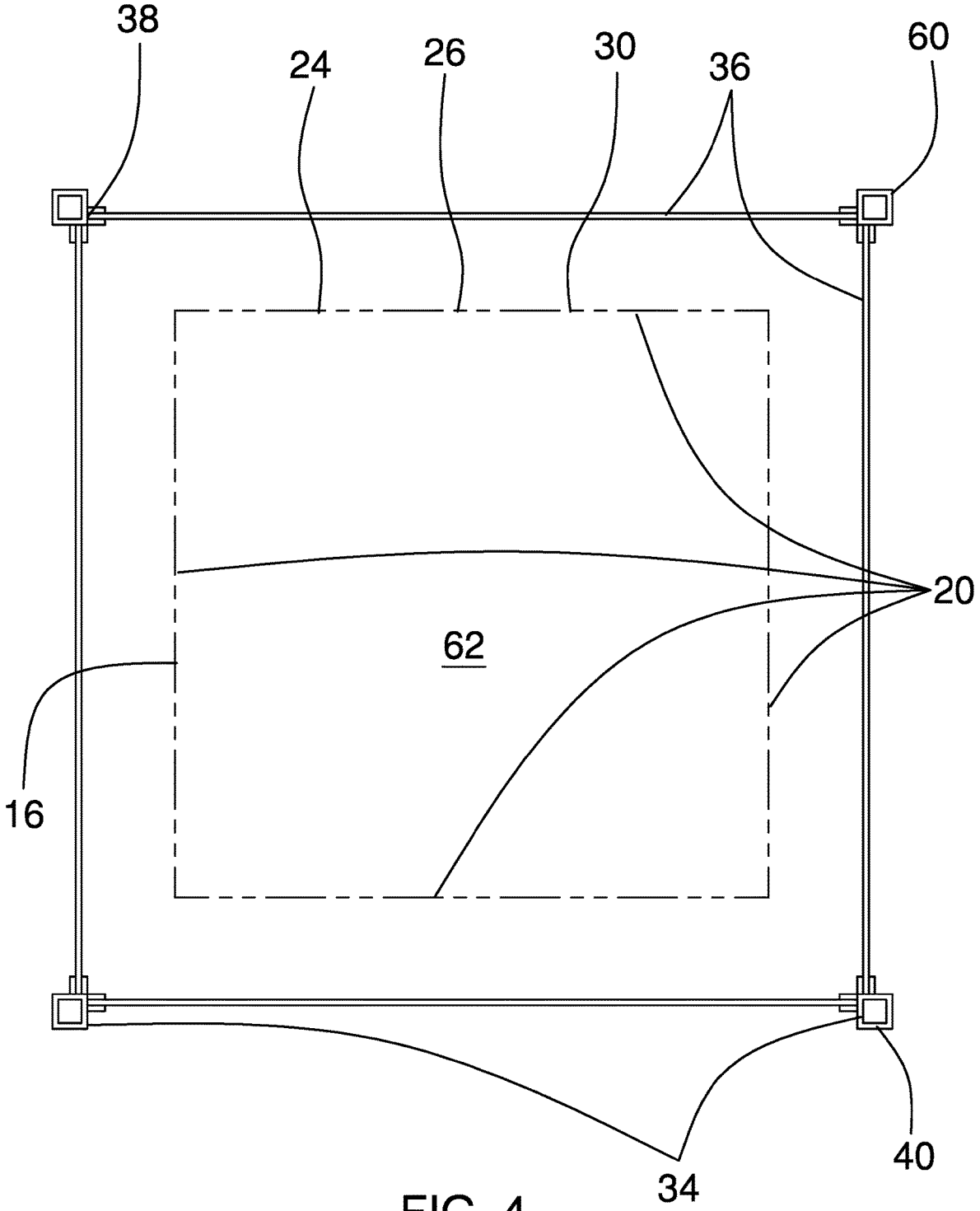
FIG. 4 is a top view of an embodiment of the disclosure.
Figure 5:
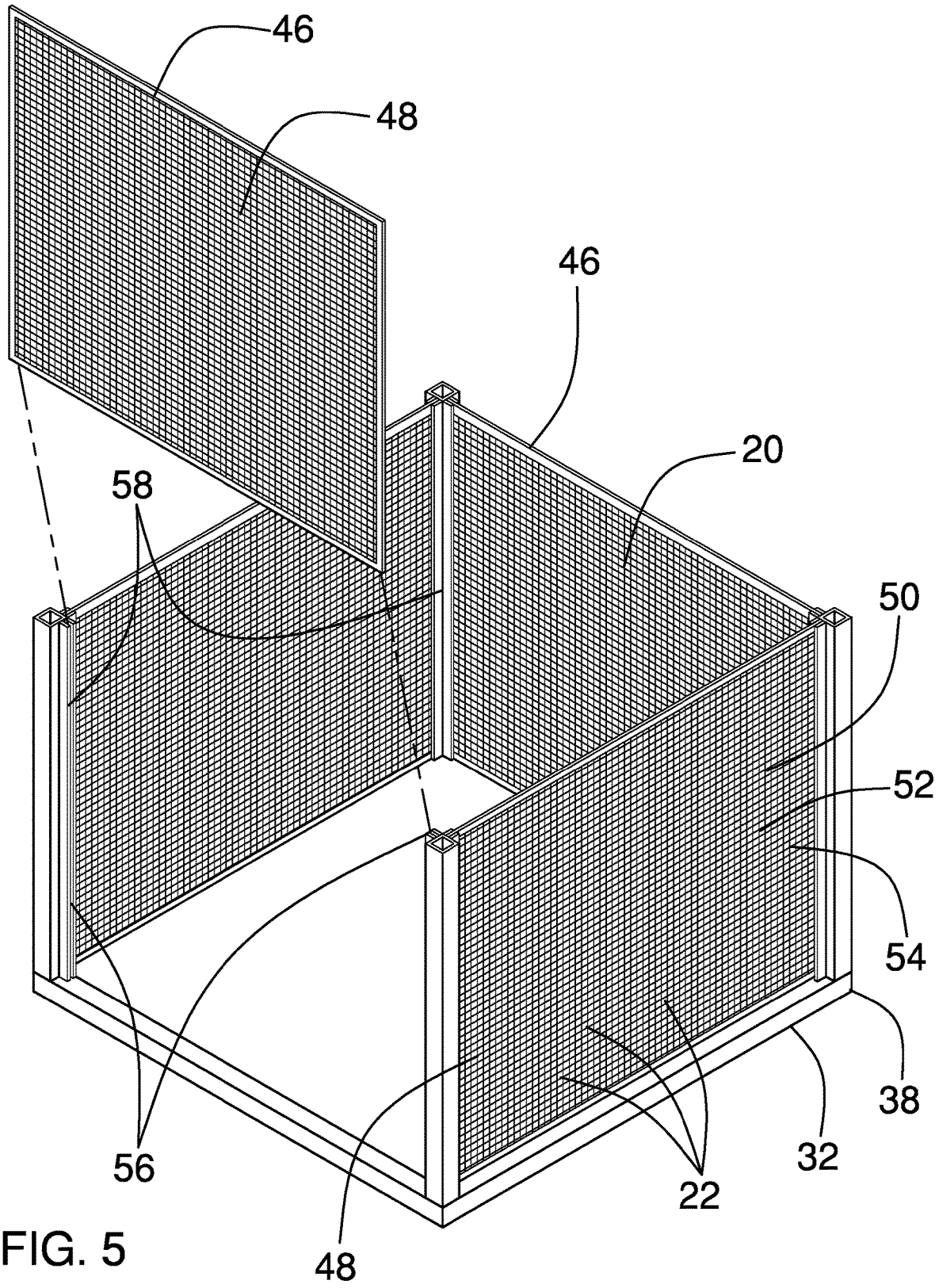
FIG. 5 is an isometric perspective view of an embodiment of the disclosure.

With reference now to the drawings, and in particular to FIGS. 1 through 8 thereof, a new protective device embodying the principles and concepts of an embodiment of the disclosure and generally designated by the reference numeral 10 will be described.

As best illustrated in FIGS. 1 through 8, the protective covering device 10 generally comprises a tube 12 and a lid 14. The tube 12 is sized complementarily to an outdoor article 16 and is configured to be positioned around the outdoor article 16 so that a bottom of the tube 12 is substantially coplanar with a lower end 18 of the outdoor article 16. The tube 12 is configured to protect substantially all side surfaces 20 of the outdoor article 16 from solar radiation, weather, and airborne debris. A plurality of apertures 22 is positioned in the tube 12 and is configured to allow airflow into and out of the tube 12.

Figure 6:
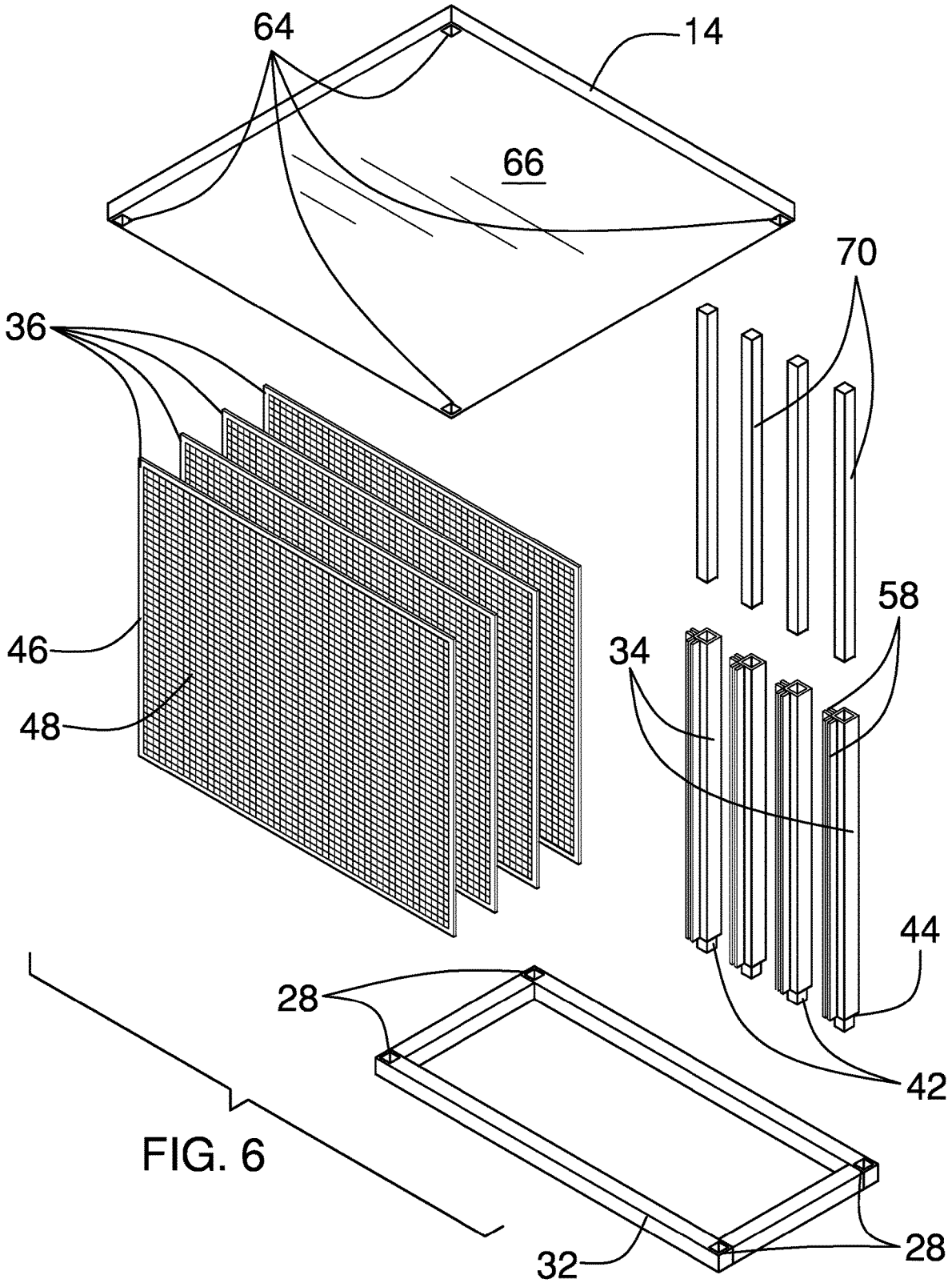
FIG. 6 is an exploded view of an embodiment of the disclosure.

The tube 12 may be sized complementarily to an outdoor element of an air conditioning system 24, to an exterior element of a heat pump system 26, to an outdoor evaporative cooler 30, or the like. The tube 12 may comprise an annular base 32, a plurality of pipes 34, and a plurality of panels 36. The annular base 32 may be rectangular, such as square, as shown in FIG. 6, although the present invention anticipates the annular base 32 being alternatively shaped. For example, annular bases 32 which are circular, oval, pentagonal, or hexagonal shaped are anticipated.

The plurality of pipes 34 is selectively engageable to the annular base 32 so that the pipes 34 extend substantially perpendicularly from the annular base 32. The plurality of pipes 34 may comprise four pipes 34, which are positioned singly proximate to corners 38 of the annular base 32. The pipes 34 may have a rectangular cross-sectional profile 40, although the present invention anticipates pipes 34 having alternatively shaped cross-sectional profiles 40, such as, but not limited to, rectangular, circular, pentagonal, hexagonal, and the like.

Each of a plurality of tenons 42 is engaged to a lower terminus 44 of a respective pipe 34. A plurality of mortices 28 is positioned in the annular base 32. The mortices 28 are complementary to the tenons 42 so that each mortice 28 is positioned for insertion of a tenon 42 engaged to a respective pipe 34 to engage the respective pipe 34 to the annular base 32. The present invention anticipates the pipes 34 being hingedly engaged to the annular base 32 and being attachable to the annular base 32 by other attachment means, such as, but not limited to, screwing, bolting, and the like.

Each panel 36 is selectively engageable to a respective pair of adjacently positioned pipes 34 so that the panel 36 extends between the respective pair of adjacently positioned pipes 34. Each panel 36 comprises a frame 46, which defines a field 48, and a screen 50, a mesh 52, a grate 54, or the like, which is engaged to the frame 46 and extends across the field 48.

A plurality of slats 56 is engaged to the pipes 34 defines a plurality of channels 58. Two channels 58 are positioned on each pipe 34 with the channels 58 extending from proximate to the lower terminus 44 to proximate to an upper terminus 60 of the pipe 34. Respective channels 58, which are positioned on adjacently positioned pipes 34, are positioned for insertion of a frame 46 of a respective panel 36 to engage the respective panel 36 to the adjacently positioned pipes 34. The present invention anticipates the panels 36 be alternatively engaged to the pipes 34, such as, for example, by means of slots extending into the pipes 34, by hinged engagement to the pipes 34 allowing the tube 12 to be foldable, and the like.

The lid 14 is selectively engageable to a top 72 of the tube 12 and thus is configured to protect an upper surface 62 of the outdoor article 16. A plurality of recesses 64 extends into a lower face 66 of the lid 14 proximate to a perimeter 68 of the lid 14. Each of a plurality of rods 70 is selectively insertable into a respective recess 64 and a respective pipe 34. The lid 14 thus is engaged to the plurality of pipes 34 and is selectively positionable relative to the upper surface 62 of the outdoor article 16. The present invention also anticipates the lid 14 being engageable to the tube 12 by other engagement means, such as, but not limited to, screwing, clamping, and the like. The extent to which the rods 70 extend from the pipes 34 can be controlled by means well known to those skilled in the art of extendable pipes, tubes, and rods, such as, but not limited to, flip lock clamps, twist lock rings, button clips, ball lock pins, and the like.

Figure 7:
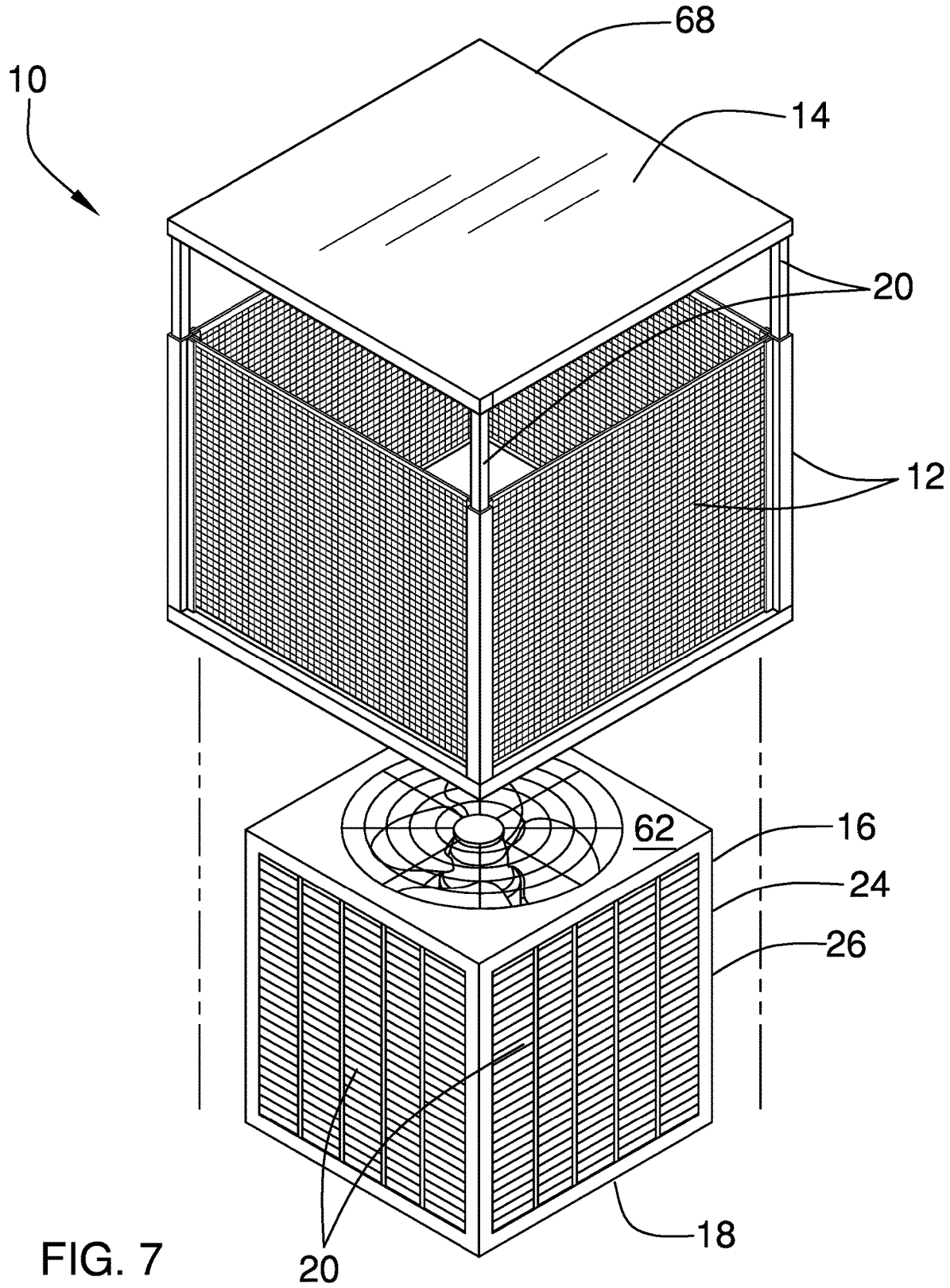
FIG. 7 is an in-use view of an embodiment of the disclosure.
Figure 8:
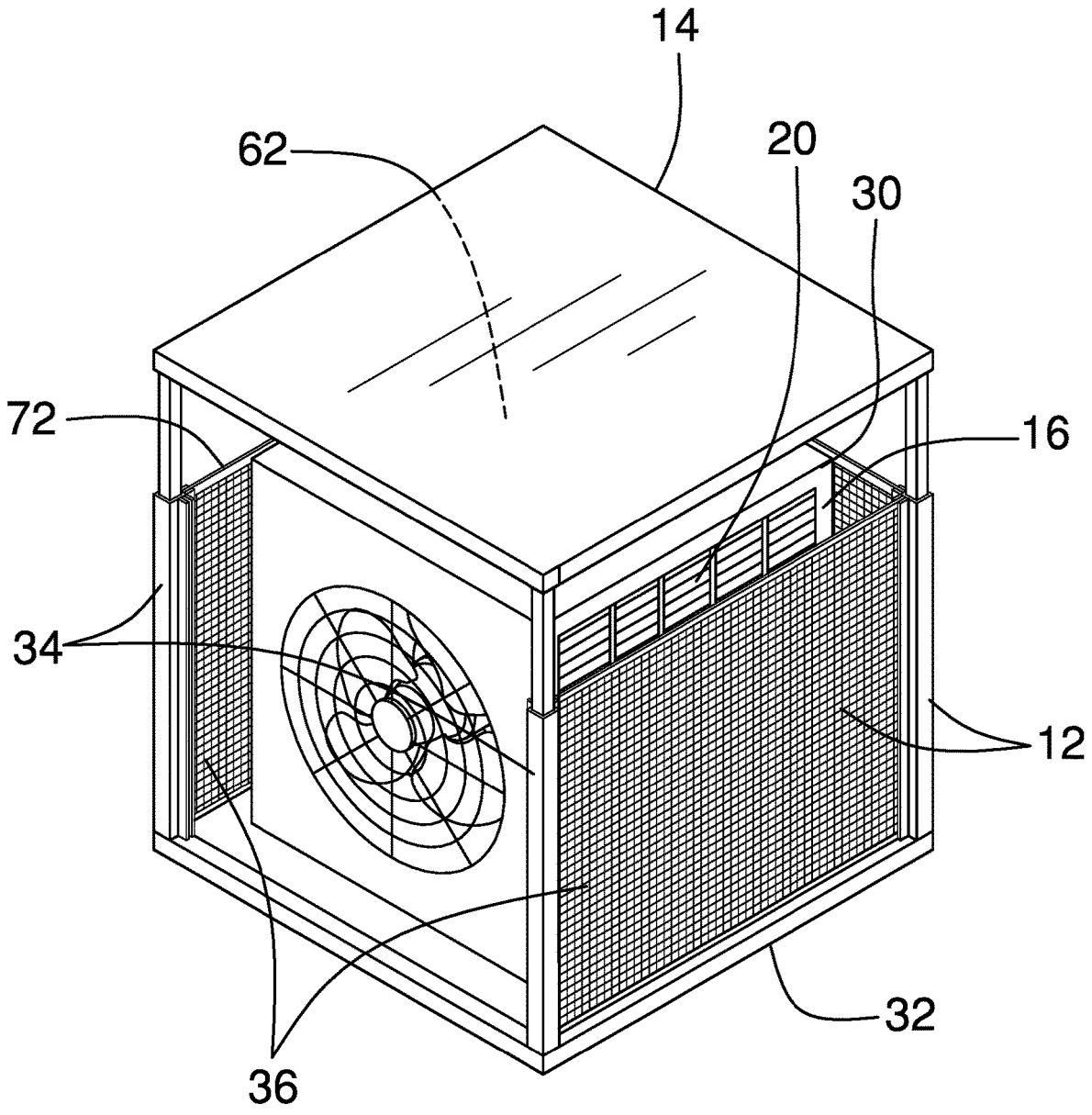
FIG. 8 is an in-use view of an embodiment of the disclosure.

In one example of use, as shown in FIG. 7, the annular base 32 is positioned on the ground around the outdoor element of an air conditioning system 24 or an exterior element of a heat pump system 26. One pipe 34 is inserted into each of the cavities 42, and the panels 36 then are inserted between adjacently positioned pipes 34 and into the channels 58. The rods 70 are inserted into the recesses 64 in the lid 14 and then into the pipes 34 so that the lid 14 is positioned above the upper surface 62 of the outdoor element 24 or the exterior element 26. The panels 36 and the lid 14 protect the outdoor element 24 or the exterior element 26 from solar radiation, thereby increasing its efficiency. The panels 36 and the lid 14 also may protect the outdoor element 24 or the exterior element 26 from hail, snow, debris launched by mowers, and the like. In another example of use, as shown in FIG. 8, one of the panels 36 is not attached to the pipes 34 so that intake of air into an outdoor evaporative cooler 30 is not impeded.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A protective covering device comprising:

a tube being sized complementarily to an outdoor article, wherein the tube is configured for positioning around the outdoor article, such that a bottom of the tube is substantially coplanar with a lower end of the outdoor article, wherein the tube is configured for protecting substantially all side surfaces of the outdoor article;

a plurality of apertures positioned in the tube, wherein the apertures are configured for flowing of air into and out of the tube;

a lid selectively engageable to a top of the tube, wherein the lid is configured for protecting an upper surface of the outdoor article, wherein the tube comprises an annular base, a plurality of pipes selectively engageable to the annular base, such that the pipes extend substantially perpendicularly from the annular base, and a plurality of panels, each panel being selectively engageable to a respective pair of adjacently positioned pipes, such that the panel extends between the respective pair of adjacently positioned pipes:

a plurality of recesses extending into a lower face of the lid proximate to a perimeter of the lid; and a plurality of rods, each rod being selectively insertable into a respective recess and a respective pipe, such that the lid is engaged to the plurality of pipes and such that the lid is selectively positionable relative to the upper surface of the outdoor article.

2. The protective covering device of claim 1, wherein the tube is sized complementarily to an outdoor element of an air conditioning system, to an exterior element of a heat pump system, or to an outdoor evaporative cooler.

3. The protective covering device of claim 1, wherein:
the annular base is rectangular; and
the plurality of pipes comprises four pipes positioned singly proximate to corners of the annular base.

4. The protective covering device of claim 1, wherein the pipes having a rectangular cross-sectional profile.

5. The protective covering device of claim 1, further including:
a plurality of tenons, each tenon being engaged to a lower terminus of a respective pipe;
a plurality of mortices positioned in the annular base, the mortices being complementary to the tenons, such that each mortice is positioned for insertion of a tenon engaged to a respective pipe for engaging the respective pipe to the annular base.

6. The protective covering device of claim 1, wherein each panel comprises:
a frame defining a field; and
a screen, mesh, or grate engaged to the frame and extending across the field.

7. The protective covering device of claim 6, further including a plurality of slats engaged to the pipes defining a plurality of channels, such that two channels are positioned on each pipe with the channels extending from proximate to a lower terminus to proximate to an upper terminus of the pipe, and such that respective channels positioned on adjacently positioned pipes are positioned for insertion of a frame of a respective panel for engaging the respective panel to the adjacently positioned pipes.

8. A protective covering system comprising:
an outdoor article comprising one of an outdoor element of an air conditioning system, an exterior element of a heat pump system, and an outdoor evaporative cooler;
a tube sized complementarily and positioned around the outdoor article, such that a bottom of the tube is substantially coplanar with a lower end of the outdoor article, wherein the tube is configured for protecting substantially all side surfaces of the outdoor article;
a plurality of apertures positioned in the tube, wherein the apertures are configured for flowing of air into and out of the tube;
a lid selectively engageable to a top of the tube, wherein the lid is configured for protecting an upper surface of the outdoor article;
wherein the tube comprises
an annular base,
a plurality of pipes selectively engageable to the annular base, such that the pipes extend substantially perpendicularly from the annular base, and
a plurality of panels, each panel being selectively engageable to a respective pair of adjacently positioned pipes, such that the panel extends between the respective pair of adjacently positioned pipes:
wherein the annular base is rectangular;
wherein the plurality of pipes comprises four pipes positioned singly proximate to corners of the annular base;
a plurality of recesses extending into a lower face of the lid proximate to a perimeter of the lid; and
a plurality of rods, each rod being selectively insertable into a respective recess and a respective pipe, such that the lid is engaged to the plurality of pipes and such that the lid is selectively positionable relative to the upper surface of the outdoor article.

9. The protective covering system of claim 8, wherein the pipes having a rectangular cross-sectional profile.

10. The protective covering system of claim 8, further including:
a plurality of tenons, each tenon being engaged to a lower terminus of a respective pipe;
a plurality of mortices positioned in the annular base, the mortices being complementary to the tenons, such that each mortice is positioned for insertion of a tenon engaged to a respective pipe for engaging the respective pipe to the annular base.

11. The protective covering system of claim 8, wherein each panel comprises:
a frame defining a field; and
a screen, mesh, or grate engaged to the frame and extending across the field.

12. The protective covering system of claim 11, further including a plurality of slats engaged to the pipes defining a plurality of channels, such that two channels are positioned on each pipe with the channels extending from proximate to a lower terminus to proximate to an upper terminus of the pipe, and such that respective channels positioned on adjacently positioned pipes are positioned for insertion of a frame of a respective panel for engaging the respective panel to the adjacently positioned pipes.

13. A protective covering device comprising:
a tube being sized complementarily to an outdoor article, wherein the tube is configured for positioning around the outdoor article, such that a bottom of the tube is substantially coplanar with a lower end of the outdoor article, wherein the tube is configured for protecting substantially all side surfaces of the outdoor article, the tube being sized complementarily to an outdoor element of an air conditioning system, to an exterior element of a heat pump system, or to an outdoor evaporative cooler, the tube comprising:
an annular base, the annular base being rectangular,
a plurality of pipes selectively engageable to the annular base, such that the pipes extend substantially perpendicularly from the annular base, the plurality of pipes comprising four pipes positioned singly proximate to corners of the annular base, the pipes having a rectangular cross-sectional profile,
a plurality of tenons, each tenon being engaged to a lower terminus of a respective pipe,
a plurality of mortices positioned in the annular base, the mortices being complementary to the tenons, such that each mortice is positioned for insertion of a tenon engaged to a respective pipe for engaging the respective pipe to the annular base,
a plurality of panels, each panel being selectively engageable to a respective pair of adjacently positioned pipes, such that the panel extends between the respective pair of adjacently positioned pipes, each panel comprising:
a frame defining a field, and
a screen, mesh, or grate engaged to the frame and extending across the field, and
a plurality of slats engaged to the pipes defining a plurality of channels, such that two channels are positioned on each pipe with the channels extending from proximate to the lower terminus to proximate to an upper terminus of the pipe, and such that respective channels positioned on adjacently positioned pipes are positioned for insertion of a frame of a respective panel for engaging the respective panel to the adjacently positioned pipes;

a plurality of apertures positioned in the tube, wherein the apertures are configured for flowing of air into and out of the tube;

a lid selectively engageable to a top of the tube, wherein the lid is configured for protecting an upper surface of the outdoor article;

a plurality of recesses extending into a lower face of the lid proximate to a perimeter of the lid; and a plurality of rods, each rod being selectively insertable into a respective recess and a respective pipe, such that the lid is engaged to the plurality of pipes and such that the lid is selectively positionable relative to the upper surface of the outdoor article.

* * * * *